US011794089B1

(12) United States Patent
Landess

(10) Patent No.: US 11,794,089 B1
(45) Date of Patent: Oct. 24, 2023

(54) SKI POLE HOLDER

(71) Applicant: Sami Kinetic Innovations LLC, Las Vegas, NV (US)

(72) Inventor: Steve Landess, Las Vegas, NV (US)

(73) Assignee: Sami Kinetic Innovations LLC, Las Vegas, NV (US)

( * ) Notice: Subject to any disclaimer, the term of this patent is extended or adjusted under 35 U.S.C. 154(b) by 0 days.

(21) Appl. No.: 18/072,879

(22) Filed: Dec. 1, 2022

(51) Int. Cl.
*A63C 11/22* (2006.01)

(52) U.S. Cl.
CPC ..... *A63C 11/228* (2013.01)

(58) Field of Classification Search
CPC ..... A63C 11/22; A63C 11/228; A63C 11/222
See application file for complete search history.

(56) References Cited

U.S. PATENT DOCUMENTS 3,469,857 A * 9/1969 Gottfried ..... A63C 9/0847 335/219
4,588,115 A 5/1986 Uyeda
4,702,495 A 10/1987 Roda
4,793,627 A * 12/1988 Monreal ..... A63C 5/06 280/823
4,953,892 A 9/1990 Adkins
5,141,251 A 8/1992 Smith
5,368,533 A * 11/1994 Feuer ..... A63B 21/154 482/134
6,347,808 B1 * 2/2002 Pennington ..... A63C 5/06 280/809
8,544,890 B2 * 10/2013 Whitehead ..... A63C 5/06 280/809
9,828,004 B2 11/2017 Calamia
2011/0291397 A1 12/2011 Rodriguez
2022/0203211 A1 * 6/2022 Carroll ..... A63C 11/025

FOREIGN PATENT DOCUMENTS

DE 3219198 A * 11/1983 ..... A63C 11/22
DE 10113816 A1 * 3/2002 ..... A63C 11/02
HR P20190311 A2 * 8/2020
WO WO-2010100394 A1 * 9/2010 ..... A63C 5/06

* cited by examiner

*Primary Examiner* — James A Shriver, II
*Assistant Examiner* — Michael T. Walsh
(74) *Attorney, Agent, or Firm* — Argus Intellectual Enterprise; Daniel Enea; Jordan Sworen

(57) ABSTRACT

A ski pole holder is provided. The ski pole holder is positioned toward a toe side of a ski footwear, to secure a portion of the ski pole within a channel of the ski pole holder. The ski pole holder includes a housing with the channel that extends towards the skier. When the skier is riding a ski lift, the ski pole is received within the housing to retain the ski pole. Fasteners within the channel secure the ski pole to the ski pole holder. The housing also includes a front sidewall and guides to help ensure that the tip of the ski pole is easily positioned within the channel. A lateral sidewall includes an open slot to provide for removal of snow that accumulates within the channel. The ski pole holder is attachable to the upper side of the ski footwear or is permanently integrated.

20 Claims, 10 Drawing Sheets

SKI POLE HOLDER

BACKGROUND OF THE INVENTION

The present invention relates to a ski pole holder. More specifically, the present invention relates to a ski pole holder that is positioned on a top side of ski footwear, such as a ski or snowshoe, such that the channel of the ski holder can securely receive a tip of the ski pole when not in use. In one instance, the ski pole holder is used to secure the tip of the ski pole when the wearer is riding a ski lift.

Many winter activities, such as skiing, snowboarding, and snowshoeing, often require a ski lift to reach the top of a trail or an uphill position on a mountain. The ski lift picks up skiers and non-skiers at the bottom of the ski run or trail and lift them up a hill.

During the ski lift ride, the skier may be raised off the ground and cannot get off from the ski lift until the ski lift reaches the top. Typically, once on a ski lift, skiers are required to carry or hold their poles in their hands or to sit on top of the ski poles when room allows for this while traveling on the ski lift. Many skiers also take this opportunity to relax or adjust ski clothing. These activities are hampered, however, by the need to keep a firm hold on the ski poles. Most skiers attempt to hold their poles while riding the ski lift., however, despite best efforts, many skiers drop their ski poles during the ski lift ride. If a ski pole falls to the ground below the ski lift, the skier has no obvious way of retrieving the pole. These dropped poles are often lost or stolen. Moreover, these dropped ski poles may fall within the ski path and form a hazard to other skiers. It is therefore desirable that skiers have some way to secure their ski poles to the ski lift during the ski lift ride.

Some ski poles incorporate a flexible wrist strap into the ski pole handle that can be loosely secured to the wearer. The flexible strap wraps around the back of the skier's hand as the skier grips the ski pole handle. During the ski lift ride, the skier may attempt to hang the wrist strap of the ski pole from a part of the ski lift for convenience. However, the wrist strap was not designed for such securement and often becomes unsecure during transit. Therefore, a secure ski pole holder that engages the poles during the lift ride would alleviate many of these problems and safety hazards.

In light of the devices disclosed in the known art, it is submitted that the present invention substantially diverges in design elements and methods from the known art and consequently it is clear that there is a need in the art for an improvement for ski pole holders. In this regard the instant invention substantially fulfills these needs.

SUMMARY OF THE INVENTION

In view of the foregoing disadvantages inherent in the known types of ski pole holders now present in the known art. The present invention provides a new ski pole holder for securing the ski pole while the user is seated, such as when riding a ski lift.

It is an objective of the present invention to provide a ski pole holder that secures to a top side of a ski footwear. In some embodiments, the ski pole holder is removably or semi-permanently, affixed to the ski by a fastener, such as an adhesive. The ski pole holder includes a channel that extends through the housing wherein the channel is sized to receive the tip of the ski pole.

It is an objective of the present invention to provide a ski pole holder having a housing with one or more raised sidewalls that extend from a base forming a channel, wherein the channel is dimensioned to receive a distal end of a ski pole. The base has a lower side which is adapted to couple to a top side of a ski footwear in a mounted position, wherein a fastener is positioned towards the second end of the channel and configured to semi-permanently secure the ski pole within the housing.

It is another objective of the present invention to provide a ski pole holder that is secured to a top side of a snowshoe.

It is another objective of the present invention to provide a ski pole holder that is permanently to a top side of a snowshoe.

It is yet another objective of the present invention to provide a ski pole holder that is integrated with the ski so as to be permanently coupled.

Moreover, it is another objective of the present invention to provide a ski pole holder to provide a front sidewall and guides that assist with the insertion of the ski pole into the channel of the housing.

It is yet another objective of the present invention to provide a ski pole holder that secures the ski pole during a ride of a ski or chair lift, where the securement greatly reduces the risk of dropping or losing the ski pole.

It is another objective of the present invention is to provide a ski pole holder that is secured to the ski such that the holder remains affixed to the ski during use such as traversing down a mountain slope.

It is yet another objective of the present invention to provide a ski pole holder having a magnet positioned at a floor of the channel for securing the ski pole within the channel.

It is another objective of the present invention is to provide a ski pole holder having open slots adjacent to the channel for clearing snow buildup within the channel.

It is therefore an object of the present invention to provide a new and improved ski pole holder that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
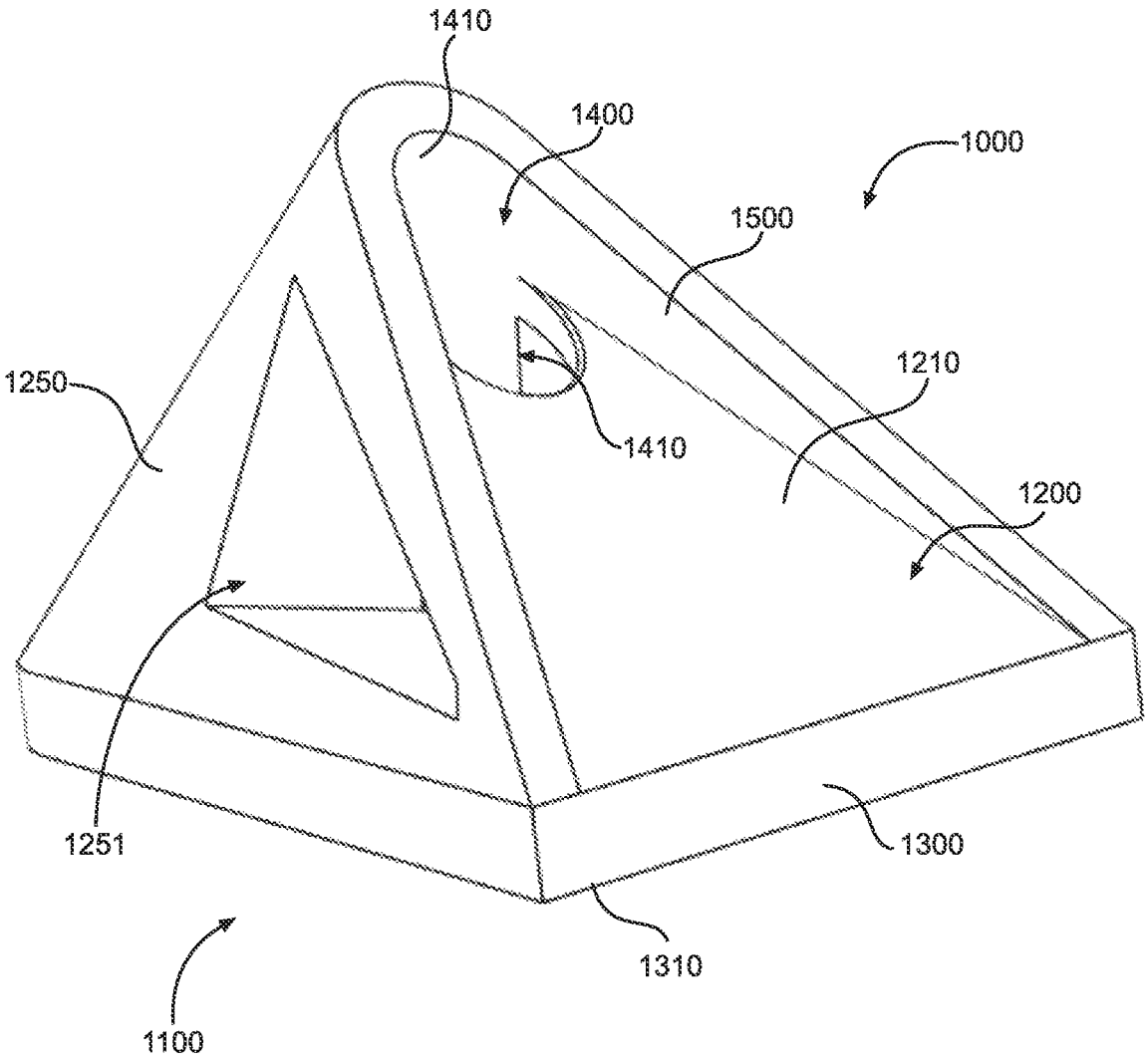
FIG. 1 shows a perspective view of an embodiment of the ski pole holder.

Reference is made herein to the attached drawings. Like reference numerals are used throughout the drawings to depict like or similar elements of the ski pole holder. For the purposes of presenting a brief and clear description of the present invention, the preferred embodiment will be discussed as used for mounting to a ski and providing a housing for resting the ski pole therein where the user is riding a ski lift. The figures are intended for representative purposes only and should not be considered to be limiting in any respect. Furthermore, the described features, structures, or characteristics may be combined in any suitable manner in one or more embodiments. In the following description, numerous specific details are provided to give a thorough understanding of embodiments.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment" does not necessarily refer to the same embodiment.

As used herein, "ski footwear" includes skis, snowshoes, or any other footwear that generally accompany use of ski poles. "Semi-permanent" or "semi-permanently" refers to coupling two or more elements in a manner that they remain coupled through ordinary usage. For example, "semi-permanently" is used to describe the fastener within the channel securing the ski pole within the channel. In this capacity, the ski pole is removable by a user lifting the ski pole with a lifting force when the ski pole is positioned within the channel.

Figure 2:
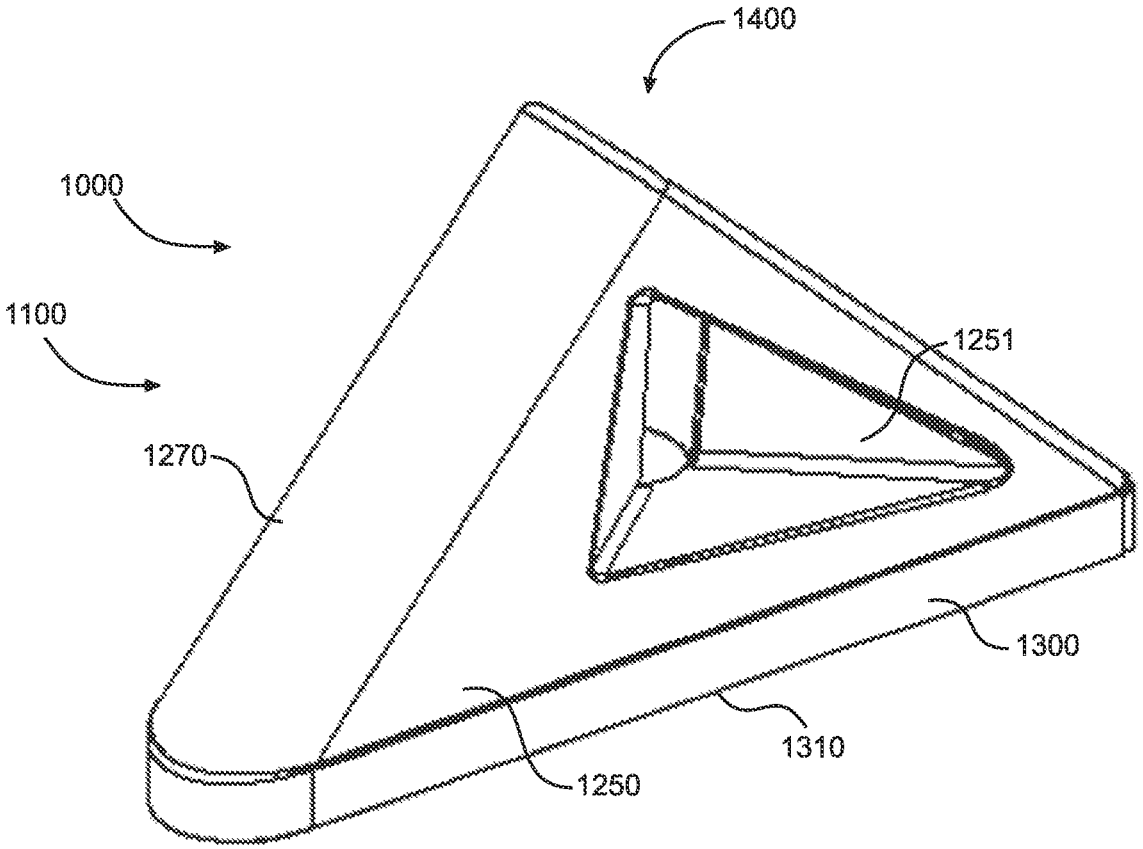
FIG. 2 shows another perspective view of an embodiment of the ski pole holder.
Figure 3:
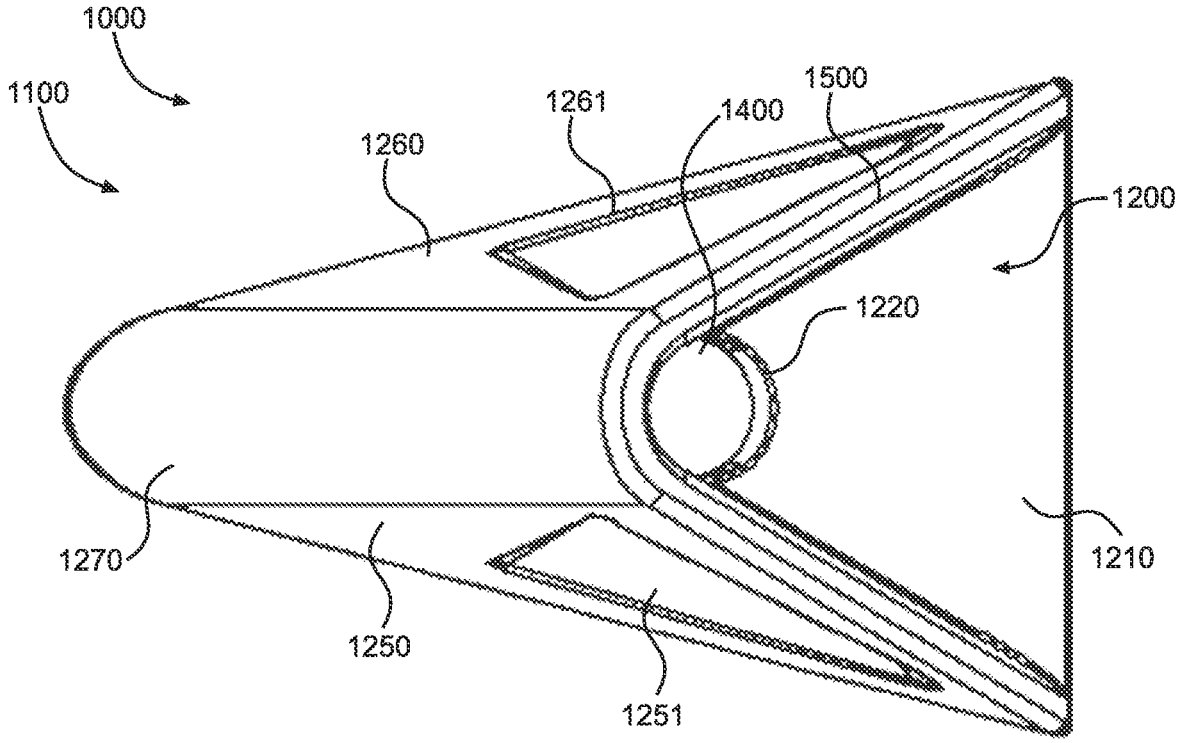
FIG. 3 shows an overhead view of an embodiment of the ski pole holder.

Referring now to FIGS. 1-3, there are shown perspective views and an overhead view of an embodiment of the ski pole holder, respectively. The ski pole holder 1000 provides a device that couples to a footwear, such as a ski, and includes a channel for receiving a ski pole when the wearer is seated or otherwise not active. The ski pole holder 1000 comprises a housing 1100 having one or more raised sidewalls 1200 that extend from a base 1300 forming a channel 1400. In the shown embodiment, the housing 1100 is generally a four-sided pyramid shape having a flat base 1300 with one or more sidewalls 1200 that extend towards a tip, wherein the tip is opposite the base 1300. The base 1300 has a tapered width extending between a rear end and a front end, wherein a front sidewall 1210 is disposed at the front end.

Figure 5A:
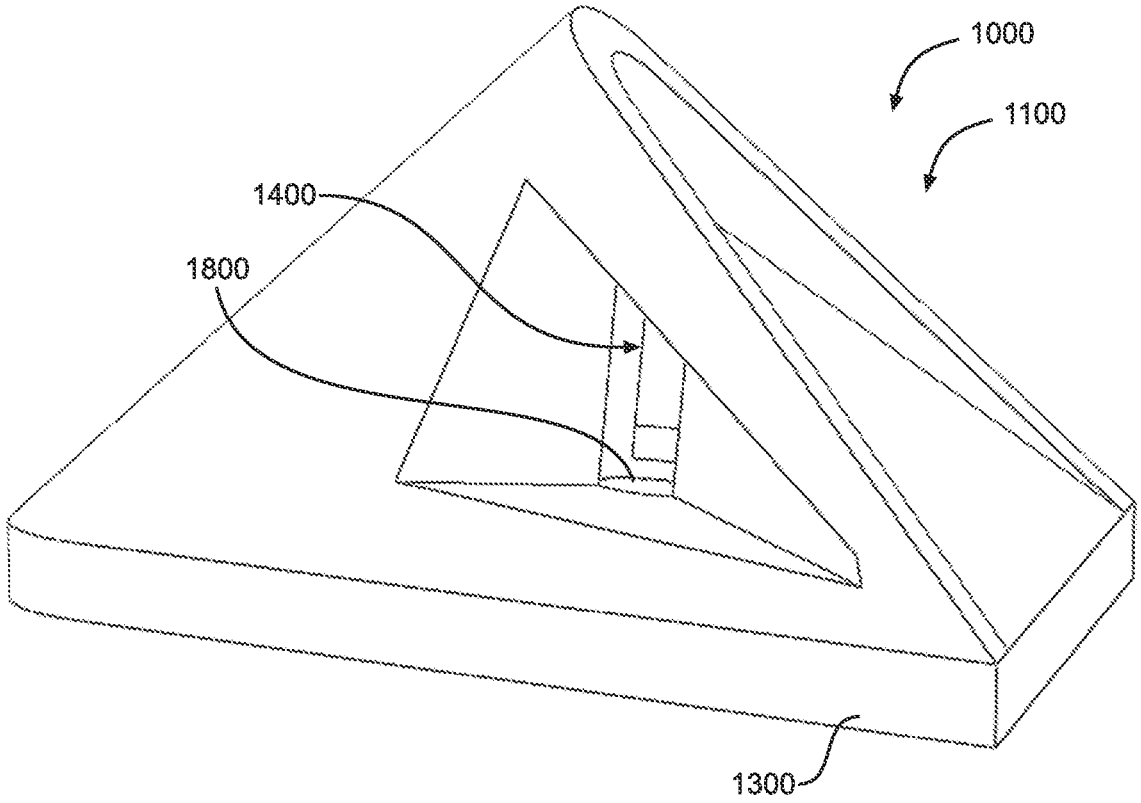
FIG. 5A shows a side perspective view of an embodiment of the ski pole holder.
Figure 6:
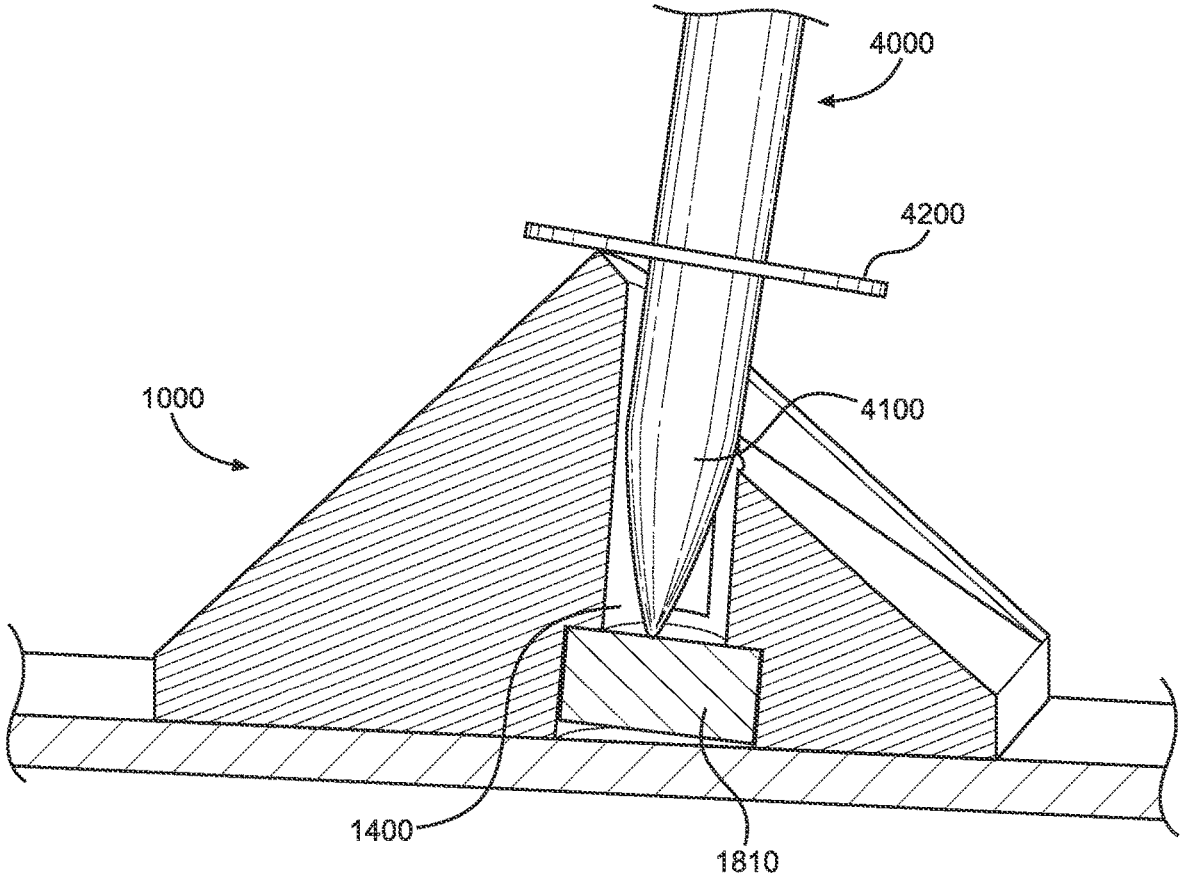
FIG. 6 shows a side view of an embodiment of the ski pole holder mounted to a top side of a ski.
Figure 7:
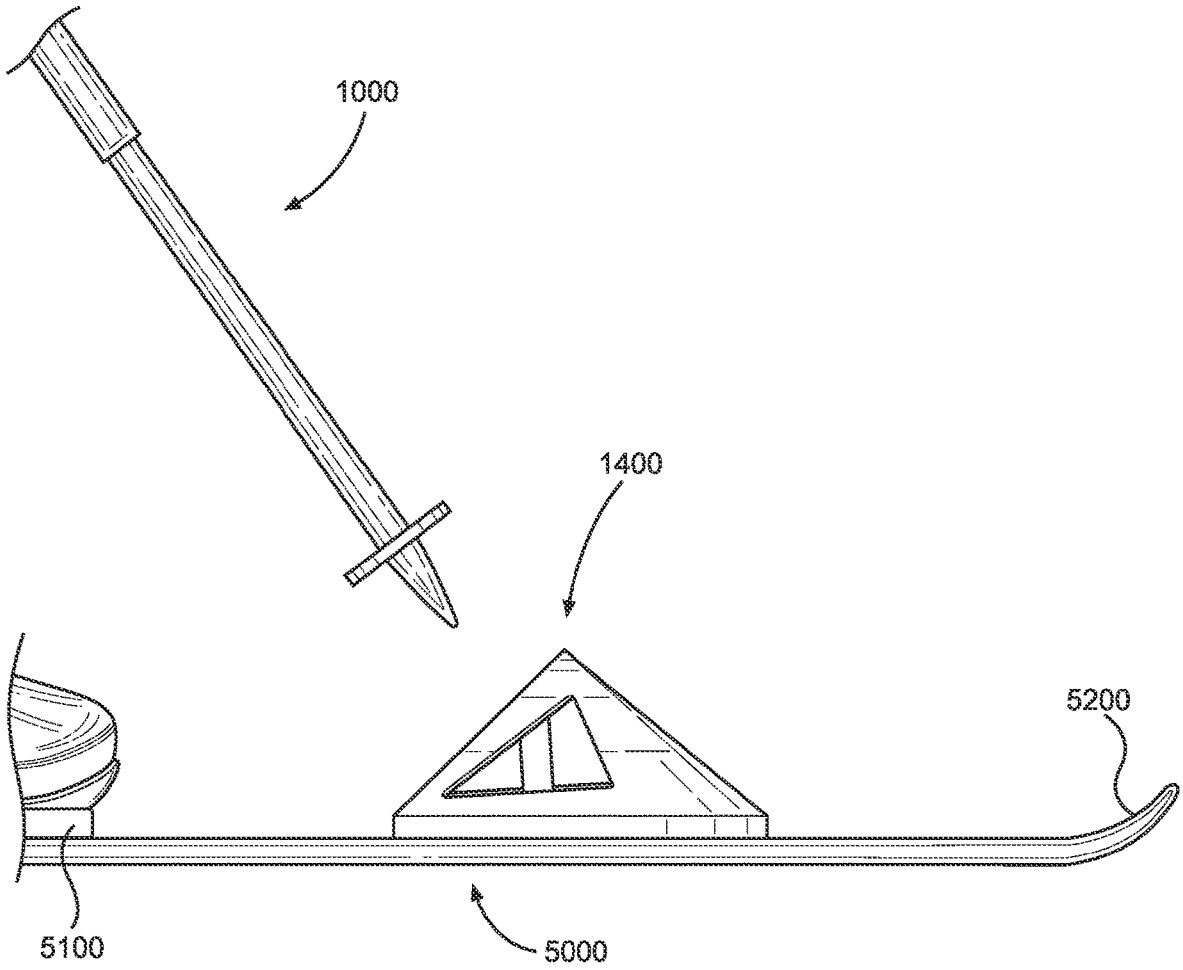
FIG. 7 shows a side view of an embodiment of the ski pole holder mounted to a ski.

In one embodiment, the channel 1400 has an open first end 1410 and a second end 1420, wherein the first and second ends 1410, 1420 are positioned on opposing sides of the housing 1100 (the second end of the channel is best shown in FIGS. 5A and 6). The channel 1400 is dimensioned to receive a distal end of a ski pole, as shown in FIG. 7. In the shown embodiment, the channel 1400 has a hollow cylindrical shape that extends between the tip and the base 1300. The base 1300 includes a lower side 1310 which is adapted to couple to a top side of a ski footwear in a mounted position. In the shown embodiment, the lower side 1310 is flat and sized to fit onto the top side of the ski. In alternative embodiments, the lower side 1310 is shaped to conform with the shape of the footwear and thereby form a bond with the footwear. For example, a snowshoe may have an inclined toe to assist with walking through snow, and the lower side 1310 of the present invention may be angled to align with such an incline.

In some embodiments, the lower side 1310 comprises an adhesive that couples with the footwear. The adhesive provides for semi-permanent attachment to the ski footwear. In one use, when the housing is mounted to the ski, the adhesive couples the housing of the ski pole holder to the ski such that during use (such as skiing) the housing remains affixed to the ski. In one embodiment, the adhesive extends along the entire face of the lower side 1310.

In the shown embodiment, the housing 1100 of the ski pole holder 1000 comprises a rounded leading sidewall 1270 for providing minimal aerodynamic drag when mounted to the ski footwear. The rounded leading sidewall 1270 is configured to be forward facing when mounted to the footwear. The rounded shape extends an entire length of the sidewall and is angled toward the tip, thereby allowing the air to flow over the holder 1000 without creating a drag.

In the shown embodiment, the one or more raised sidewalls comprise a front sidewall 1210 and a pair of lateral sidewalls 1250, 1260 disposed adjacent to the front sidewall 1210. The front sidewall 1210 forms an opening 1220 to the channel 1400. The front sidewall 1210 is abutted by a pair of guides 1500 that extend on opposing sides of the front sidewall 1210. The guides 1500 are substantially raised from the front sidewall 1210 to guide a distal end of the ski pole to the channel 1400. In one embodiment, the guides 1500 are formed as part of the lateral sidewalls 1250, 1260. In alternative embodiments, the guides 1500 are distinct from the sidewalls 1200.

The pair of guides 1500 extend around the opening 1220 of the front sidewall 1210 and the channel 1400 forming a catch 1410 adapted to funnel the ski pole within the channel 1400. The guides 1500 and the catch 1410 form a coextensive face that is raised relative to the front sidewall 1210, wherein the front sidewall 1210 is planar. In this way, as a user attempts to seat the ski pole into the channel 1400, the ski pole slides along the front sidewall and bear against the guides 1500 and catch 1410 to direct the ski pole into the channel 1400.

In one embodiment, the pair of lateral sidewalls 1250, 1260 comprise open slots 1251, 1261 on each lateral sidewall that extend into the channel 1400. The open slots 1251, 1261 are configured to allow snow accumulation within the channel 1400 to be removed therefrom. In some embodiments, the housing 1100 also comprises other slots for allowing snow to flow through the channel 1400 and the housing 1100.

Figure 4:
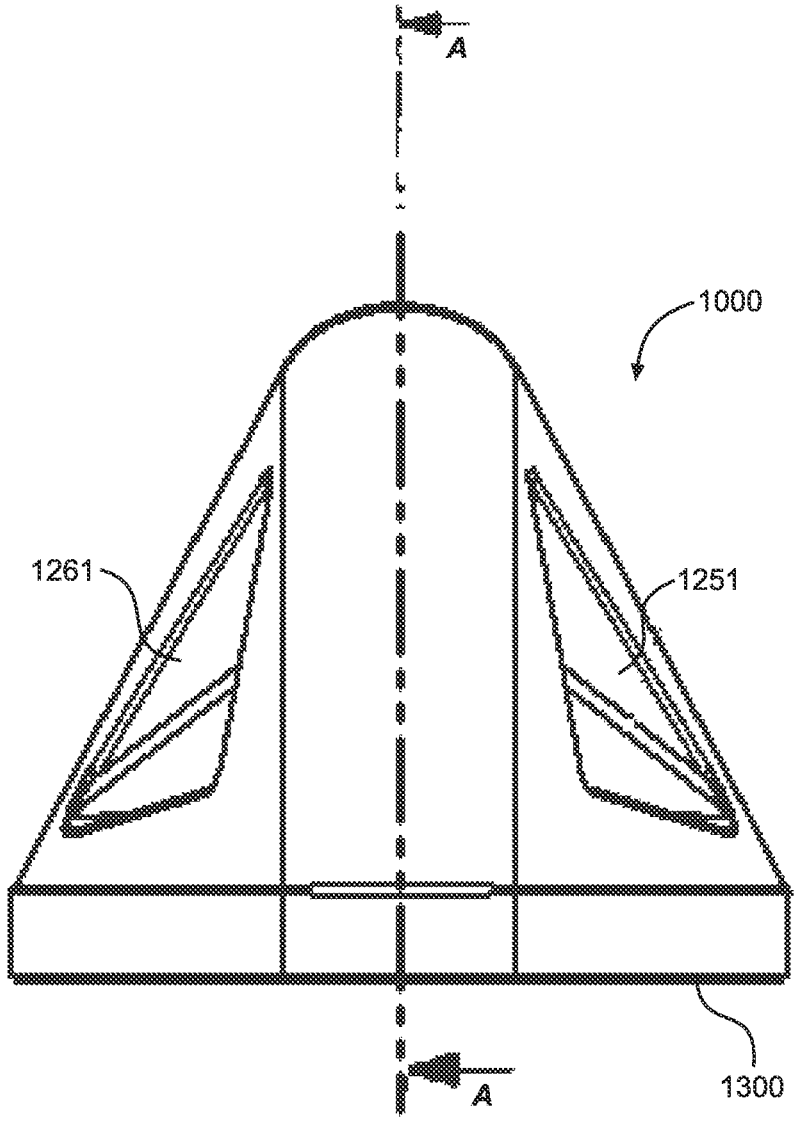
FIG. 4 shows a front-end view of an embodiment of the ski pole holder.
Figure 5B:
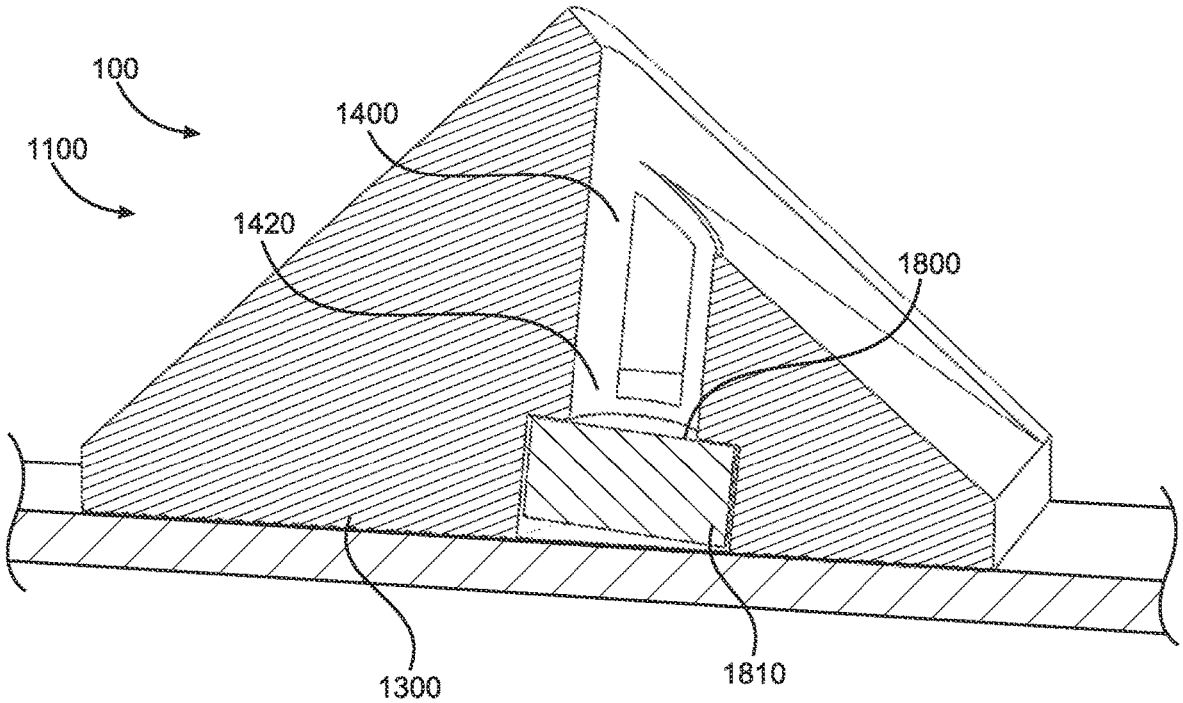
FIG. 5B shows a side cutaway view of an embodiment of the ski pole holder taken along lines A-A of FIG. 4.

Referring now to FIGS. 4-5B, there is shown a front-end view of an embodiment of the ski pole holder, a side perspective view of an embodiment of the ski pole holder, and a side cutaway view of an embodiment of the ski pole holder taken along lines A-A of FIG. 4, respectively. In the shown embodiment, the ski pole holder 1000 is symmetrical about a vertical plane, such as the vertical plane taken along line A-A of FIG. 4. In this way, a single holder can be used on either a right or left footwear. In some embodiments, the ski pole holder comprises a left and right ski pole holder 1000, wherein the left-right ski pole holders 1000 are angled to fit atop the top side of the footwear. In yet other embodiments, the ski pole holder 1000 may be asymmetrical to fit appropriately with the footwear.

In some embodiments, the channel 1400 comprises the second end 1420 that terminates at a floor 1800. In the shown embodiment, the floor 1800 is a position within the housing 1100 and is raised above the base 1300. In other embodiments, the floor 1800 is positioned within the base 1300. A fastener 1810, such as a magnet, is disposed at the second end of the channel 1420. The magnet 1810 is sufficiently strong to hold the ski pole within the channel 1400 and allow for a user to remove the ski pole with a lifting force. In some embodiments, the magnet 1810 is removable from a chamber in the floor 1800. In this way, the channel 1400 can be cleaned and a second magnet of lesser or greater force may be used to replace the original magnet 1810.

In an alternate embodiment, the second end 1420 of the channel 1400 extends through the base 1300. The channel 1400 may provide fasteners along an interior face of the channel or may not provide any fasteners. The fasteners may include magnets adapted to engage with the tip of the ski pole when the tip is seated within the channel. Such an embodiment would also provide a pathway to remove snow built up within the channel during usage.

Referring to FIGS. 6 and 7, there are shown views of a side view of an embodiment of the ski pole holder mounted to a top side of a ski and of a side view of an embodiment of the ski pole holder mounted to a ski, respectively. Referring to FIG. 6 specifically, in the shown embodiment, the distal end of the ski pole 4000 is seated within the channel 1400 of the ski pole holder 1000. The ski pole 4000 comprises a tip 4100 adapted to penetrating snow and ice and assisting the carrier navigate. The ski pole 4000 also includes a cover 4200 that prevents over penetration of the tip 4100 through the snow and ice, whereby the cover 4200 increases surface area gives sufficient resistance when used by the carrier to push off therefrom. In the shown embodiment, the tip 4100 of the ski pole is seated within the channel 1400. The tip 4200 can abut the front sidewall and the guides until the tip 4200 is received within the channel 1400. Once received, the magnet fastener 1810 couples the ski pole 4000 to the ski pole holder 1000. The cover 4200 rests on the face of the lateral sidewalls and prevents rotation within the channel 1400. In some embodiments, the diameter of the channel 1400 remains constant and sized to receive the tip 4100 of the ski pole 4000. In other embodiments, the channel 1400 is tapered between the second end and the first end. In this way, the tip 4100 which may be suitably tapered, fits snuggly therein.

Referring to FIG. 7, the ski pole holder 1000 is disposed between a tip of the ski and the ski bindings, such that the skier has forward access to the ski pole holder. The ski binding 5100 is generally positioned, between the tip 5200 and tail 5300 (shown in this figure) of the ski 5000, at a medial portion. The channel 1400 of the ski pole holder 1000 is oriented towards the skier and angled towards the medial portion of ski forming an acute angle therewith.

In one embodiment, the ski pole holder is integrated with a ski footwear. The ski pole holder may be injection molded with the ski footwear forming a monolithic structure. One benefit of such an embodiment, is to prevent unwanted separation of the ski pole holder from the ski footwear. The ski pole holder integrated with ski footwear comprises a housing having one or more raised sidewalls that extend from a base forming a channel. The channel is dimensioned to receive a distal end of a ski pole, the channel having an open first end and a second end; the base extending from a top side of the ski footwear in a mounted position; wherein a fastener is positioned towards the second end of the channel and configured to semi-permanently secure the ski pole within the housing.

In one use, the skier is riding a ski lift, such as a chair lift, wherein the legs of the skier hang freely from the chair above the ground. The ski pole holder is mounted to the ski and allows the skier to insert the ski pole into the channel of the ski pole holder. The ski poles are often accompanied with wrist straps that secure to the skier at the wrist. The ski pole holder secures the ski pole and relieves the skier from having to hold the ski poles in an elevated position. Additionally, the ski pole holder minimizes the risk of dropping the ski pole from the ski lift.

Figure 8:
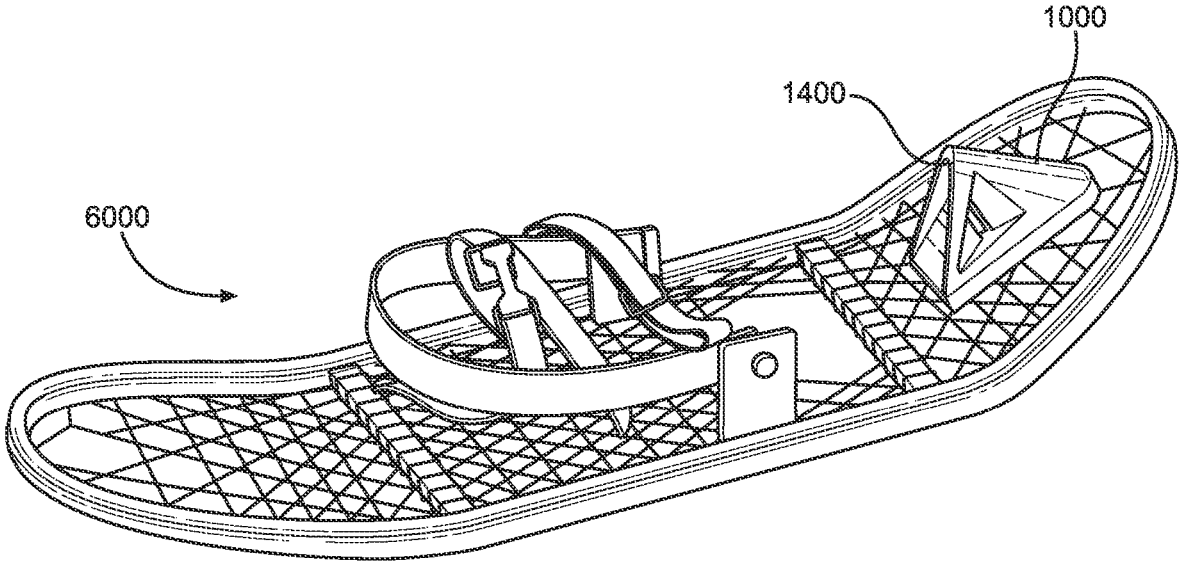
FIG. 8 shows a perspective view of an embodiment of the ski pole holder mounted to a snowshoe.

Referring to FIG. 8, there is shown a perspective view of an embodiment of the ski pole holder mounted to a snowshoe. In the shown embodiment, the ski footwear is a snowshoe 6000. The ski pole holder 1000 is adapted for use with a variety of footwear. In particular, the footwear most likely to utilize the ski pole holder are shoes or ski footwear used with activities that use ski poles, including skis, snowshoes, and the like. In the shown embodiment, the ski pole holder 1000 is positioned towards a heal portion of the snowshoe having the channel 1400 angled towards the wearer. In alternative embodiments or with other footwear applications, the ski pole holder 1000 may be positioned towards a toe end of the footwear having the channel oriented towards the wearer. Moreover, in some embodiments, the base of the ski pole holder 1000 may be adapted to match the shape of the footwear. For some embodiments, like the shown snowshoes, the base of the ski pole holder may have an elevated end to account for the raised toe of the snowshoe.

Figure 9:
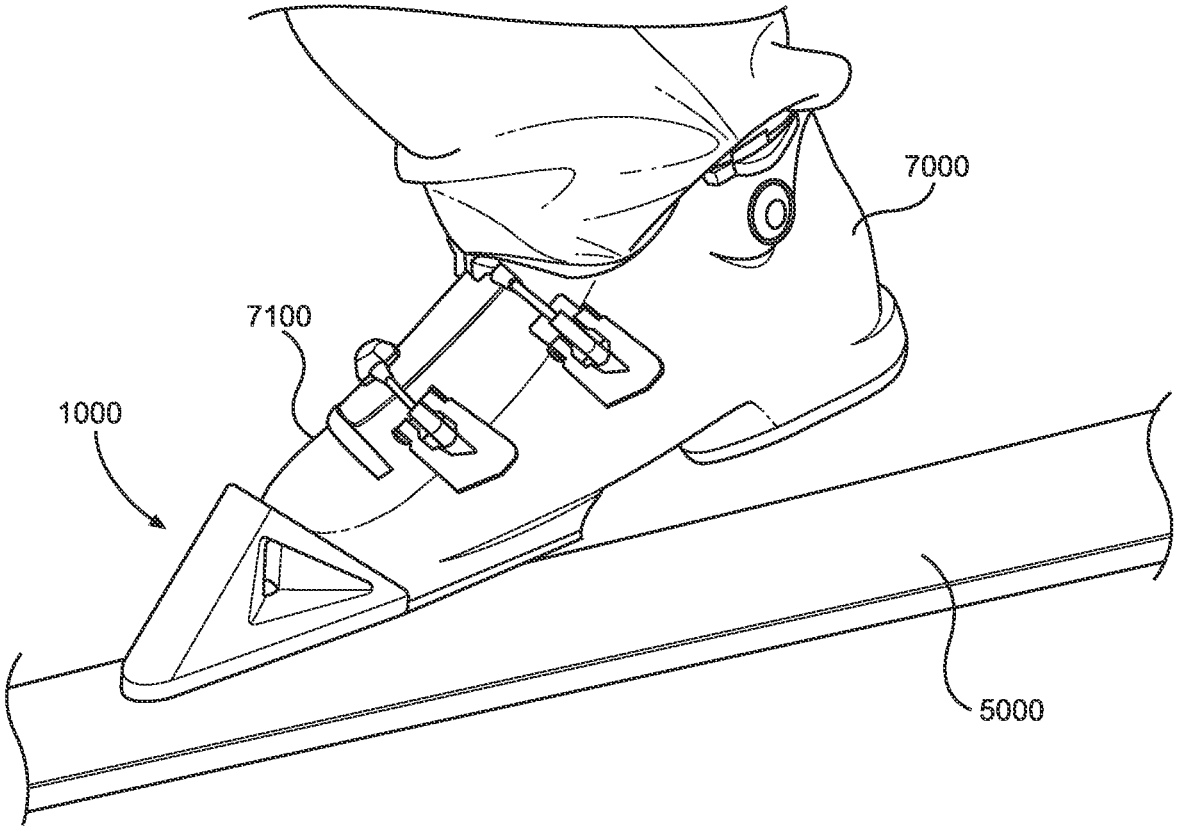
FIG. 9 shows a perspective view of an embodiment of the ski pole holder mounted directly to snow/ski boots.

Referring to FIG. 9, there is shown a perspective view of an embodiment of the ski pole holder mounted directly to snow/ski boots. In the shown embodiment, the ski pole holder 1000 is positioned at the toe end of the snow/ski boots such that access to the channel is unrestricted from the mounting configuration. In this configuration, the ski pole holder 1000 are able to be used regardless of if the ski 5000 is coupled with the snow/ski boots 7000. In an alternative embodiment, the skip pole holder 1000 is mounted to an upper 7100 of the snow/ski boots 7000. Moreover, the angle of the channel may be steeper (between sixty and ninety degrees) to account for the relative position of the toe of the boot to the hands of the user.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ski pole holder, comprising:

a housing having one or more raised sidewalls that extend from a base forming a channel;

wherein the channel is dimensioned to receive a distal end of a ski pole, the channel having an open first end and a second end;

the base includes a lower side adapted to couple to a top side of a ski footwear in a mounted position;

wherein a fastener is positioned towards the second end of the channel and configured to semi-permanently secure the ski pole within the housing;

wherein a second end of the channel terminates at a floor of the housing, wherein the fastener is disposed in the floor.

2. The ski pole holder of claim 1, wherein the one or more raised sidewalls comprise a front sidewall.

3. The ski pole holder of claim 2, wherein the front sidewall forms an opening to the channel.

4. The ski pole holder of claim 3, wherein the front sidewall is abutted by a pair of guides extending on opposing sides of the front sidewall, wherein the guides are raised from the front sidewall to guide the distal end of the ski pole to the channel.

5. The ski pole holder of claim 4, wherein the pair of guides extend around the opening of the front sidewall and the channel forming a catch adapted to funnel the ski pole within the channel.

6. The ski pole holder of claim 5, wherein the pair of guides and catch form a coextensive face that is raised relative to the front sidewall, wherein the front sidewall is planar.

7. The ski pole holder of claim 1, wherein the fastener is coaxially aligned with the channel.

8. The ski pole holder of claim 1, wherein the fastener is a magnet.

9. The ski pole holder of claim 1, wherein the channel extends at an acute angle from the base, wherein the base is flat.

10. The ski pole holder of claim 1, wherein the mounted position, the housing is secured to a toe side of the ski such that the channel is angled towards the medial portion of ski forming an acute angle therewith.

11. The ski pole holder of claim 1, wherein the one or more raised sidewalls comprise a pair of lateral sidewalls.

12. The ski pole holder of claim 11, wherein the pair of lateral sidewalls comprise open slots that extend into the channel, wherein the open slots are configured to allow snow accumulation within the channel to be removed therefrom.

13. The ski pole holder of claim 11, wherein one of the sidewalls comprises a rear sidewall disposed between the pair of lateral sidewalls, the rear sidewall having a convex curve to deflect snow in the mounted positioned and in use.

14. The ski pole holder of claim 1, wherein the base has a tapered width extending between a rear end and a front end, wherein a front sidewall is disposed at the front end.

15. The ski pole holder of claim 1, wherein the base comprises an adhesive that is configured for semi-permanent attachment to the ski.

16. The ski pole holder of claim 1, wherein the ski footwear is a ski.

17. The ski pole holder of claim 1, wherein the ski footwear is a snowshoe.

18. A ski pole holder integral with a ski footwear, comprising:

a housing having one or more raised sidewalls that extend from a base forming a channel;

wherein the channel is dimensioned to receive a distal end of a ski pole, the channel having an open first end and a second end;

the base extending from a top side of the ski footwear in a mounted position;

wherein a fastener is positioned towards the second end of the channel and configured to semi-permanently secure the ski pole within the housing.

19. The ski pole holder of claim 1, wherein the channel is linear from the open first end to the floor.

20. The ski pole holder of claim 13, wherein the rear sidewall extends linearly from the channel to a rear end of the housing.

* * * * *